US007318752B2

(12) United States Patent
Fujimoto et al.

(10) Patent No.: US 7,318,752 B2
(45) Date of Patent: Jan. 15, 2008

(54) CONNECTOR

(75) Inventors: Masaki Fujimoto, Osaka (JP); Hisahiro Ono, Osaka (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 11/467,210

(22) Filed: Aug. 25, 2006

(65) Prior Publication Data

US 2007/0049119 A1 Mar. 1, 2007

(30) Foreign Application Priority Data

Aug. 26, 2005 (JP) ..... 2005-246783

(51) Int. Cl.
*H01R 24/00* (2006.01)

(52) U.S. Cl. ..... 439/660; 439/639

(58) Field of Classification Search ..... 439/660, 439/639

See application file for complete search history.

(56) References Cited

U.S. PATENT DOCUMENTS 7,152,190 B2 * 12/2006 Overtoom ..... 714/44
2004/0033727 A1 * 2/2004 Kao ..... 439/660
2004/0248472 A1 * 12/2004 Aso et al. ..... 439/660
2005/0170699 A1 * 8/2005 Overtoom ..... 439/639

FOREIGN PATENT DOCUMENTS

JP 3109782 4/2005

OTHER PUBLICATIONS

English Language Abstract of JP 3109782.

* cited by examiner

*Primary Examiner*—Truc Nguyen
(74) *Attorney, Agent, or Firm*—Greenblum & Bernstein, P.L.C.

(57) ABSTRACT

There is provided a connector which can downsize the peripheral device. A receptacle 1 is capable of receiving both a mini-A plug based on a USB OTG standard and a mini-B plug based on a USB 2.0 standard. Further, the receptacle 1 includes first posts 41 compliant with the USB standard and second posts 42 disposed at an opposite side to the first posts 41 with a connecting part 32 inserted into a connecting recess 20 of a plug 2 therebetween. Furthermore, the plug 2 includes second contacts 72 corresponding to the second posts 42 in addition to first contacts 71 corresponding to the first posts 41. Accordingly, it is possible to transmit data other than the data which are transmitted through the known USB connector by using the second posts 42 and the second contacts 72. In addition, it is possible to down size the peripheral device compared to the case where the size increases when a connector for transmitting the other data is installed in addition to the USB connector.

7 Claims, 9 Drawing Sheets

(a)

(b)

(a)

(b)

(c)

(b)

(e)

(a)

(d)

(a)

(b)

(a)

(b)

(a)

(b)

CONNECTOR

BACKGROUND

1. Technical Field

The present invention relates to a connector capable of connecting a plug based upon a universal serial bus (USB) standard to a receptacle.

2. Related Art

The USB standard has been widely adopted in a cable or a connector used for connecting a host device such as a personal computer to a peripheral device such as a digital camera.

In the USB standard, specifications for an A connector connected to the host device side and a B connector connected to the peripheral device side are already established. However, with recent trend toward compactness of the peripheral device, such a B connector having a relatively large size has difficulties in coping with the trend, so that a specification for a mini-B connector downsized from the B connector based on a USB 2.0 standard is established, and a connector based on the specification is provided (for example, see Patent Document 1). In addition, there have been rising demands for connecting peripheral devices to each other, for example, connecting a personal digital assistant (PDA) to the digital camera and connecting the digital camera to a printer. Accordingly, a specification for a mini-A connector downsized from the A connector based on a USB on-the-go (OTG) standard which is a supplement to the USB 2.0 standard or a specification for a mini-AB connector which can be connected to any one of the mini-A connector and the mini-B connector has been established.

[Patent Document 1] Japanese Utility Model Registration No. 3,109,782

On the other hand, a particular peripheral device such as a digital media player (DMP) requires a further downsizing. However, a USB connector has only a pair of signal lines for serial transmission. Therefore, for example, even though picture data need to be transmitted concurrently with sound data, when the USB connector is used only to transmit the picture data, or when a transmission speed higher than a speed realizable with only the signal lines of the USB connector is required to transmit a high quality picture data or a high quality sound data in a short time period, it is necessary to additionally provide a connector for the sound data transmission or an auxiliary connector for accelerating the data transmission. Accordingly, it is difficult to downsize the USB connector.

SUMMARY

The present invention is contrived to solve the above-mentioned problems. An object of the present invention is to provide a connector that can downsize the peripheral device.

According to a first aspect of the present invention, there is provided a connector comprising: a receptacle capable of receiving both a mini-A plug and a min-B plug based upon a USB standard, the receptacle including: a base made of an insulating material, having a main body and a flattened connecting part protruding from the main body; a plurality of first posts made of a conductive material, having contact parts retained on one surface of the connecting part in the width direction of the connecting part; and a shell coupled to the main body of the base so as to form a fitting recess for accommodating the connecting part therewith, and a plug including: a body having a fitting part with a connecting recess which receives the connecting part of the receptacle therein and is fitted to a fitting recess; and a plurality of first contacts made of a conductive material and retained in the connecting recess so as to make an electrical contact with a corresponding one of the contact parts of the first posts when the connecting part of the base is inserted into the connecting recess of the body, wherein the receptacle has a plurality of second posts made of a conductive material, having contact parts retained on an opposite surface of the first posts of the connecting part in a direction intersecting the protruding direction of the connecting part, and wherein the plug has a plurality of second contacts made of a conductive material, having contact parts retained in the connecting recess of the body so as to make an electrical contact with the contact parts of the second posts when the connecting part is inserted into the connecting recess of the body.

According to the configuration described above, the mini-A plug or the mini-B plug based on the USB standard can be connected to the receptacle, and data other than the data which are transmitted through the known USB connector can be transmitted by using the second posts and the second contacts. Accordingly, it is possible to down size the peripheral device compared to the case where the size increases when a connector for transmitting the other data is installed in addition to the USB connector.

In a second aspect of the invention, the contact parts of the second contacts elastically protrude toward the inner side of the connecting recess, and contact pressure between the contact parts of the second contacts and the contact parts of the second posts is obtained by an elastic force of the contact parts of the second contacts.

According to the configuration described above, since it is unnecessary to elastically deform the second posts, it is unnecessary to secure a movable range of the second posts on the receptacle, thereby enabling downsizing of the receptacle.

In a third aspect of the invention, the contact parts of the first posts elastically protrude in the width direction of the connecting part, the front end portions of the contact parts of the first posts are bent toward the connecting part, and evacuated recesses for receiving the front end portions of the contact parts of the first posts when the contact parts of the first posts are elastically deformed are formed on the connecting part, and wherein the front end portions of the second posts are disposed in the fitting recess at a position deeper than the evacuated recesses, a reinforcing convex part protruding in the depth direction of the connecting part from a portion opposing to the contact parts of the second posts of the connecting part is formed on a surface opposite to the surface where the evacuated recesses of the connecting part are formed, and the height of protrusion of the reinforcing convex part is smaller than the thickness of the contact parts of the second posts.

According to the configuration described above, since decrease in mechanical strength due to the evacuated recess is reinforced by the reinforcing convex part and the size of protrusion of the reinforcing convex part is smaller than the thickness of the contact parts of the second posts, the reinforcing convex part does not increase the size of the receptacle.

In a fourth aspect of the invention, a blocking part for preventing the insertion of the plug into the fitting recess of the mini-AB receptacle based on the USB standard is formed on the plug, and a receiving part for receiving the blocking part is formed on the fitting recess of the receptacle.

According to the configuration described above, since it is impossible to insert the plug into the mini-A receptacle or the mini-B receptacle, it is possible to prevent the adhering of foreign materials to the second contact or the breakage of the second contacts when the plug is erroneously inserted into the mini-A receptacle or the mini-B receptacle.

In a fifth aspect of the invention, receiving grooves for receiving the contact parts of the second posts are formed on the connecting part of the receptacle, and the height of protrusion of the contact parts of the second posts from the bottom surface of the receiving grooves is lower than the depth of the receiving grooves.

According to the configuration described above, even when the mini-A plug or the mini-B plug is connected to the receptacle, it is possible to suppress adhering of exogenous materials attached to the fitting part of the mini-A plug or the mini-B plug to the second posts.

In a sixth aspect of the invention, the size of the fitting part of the plug is smaller than the thickness of the fitting part of the mini-A plug or the fitting part of the mini-B plug based on the USB standard, and the size of the fitting recess of the receptacle is larger than the thickness of the fitting recess of the mini-AB receptacle based on the USB standard, whereby the fitting part of the plug is fitted to the fitting recess of the receptacle. In addition, a first clamping part for inserting portions having a small width in the depth direction of the fitting part of the mini-A plug based on the USB standard between both sides of the thickness direction with a small gap therebetween, and a second clamping part for inserting portions having a large width in the depth direction of the fitting part of the mini-B plug based on the USB standard between both sides of the thickness direction with a small gap therebetween are formed on the inner surface of the fitting recess of the receptacle.

According to the configuration described above, since the plug is supported by the first and second clamping parts when the mini-A plug or the mini-B plug is connected to the receptacle, excessive force is not likely to be applied to the connecting part of the receptacle even when the plug is twisted as compared with the case where the plug is supported only by the connecting part, thereby eliminating the possibility of breakage of the connecting part.

In a seventh aspect of the invention, the first and second posts have terminal parts disposed at an opposite side to the connecting part with the main body of the base therebetween and used for mounting on a printed wiring board, and the terminal parts of the second posts are disposed at both sides of the width direction of the connecting part with the terminal parts of the first posts therebetween.

According to the configuration described above, when the receptacle is mounted on the printed wiring board, the terminal part of the first posts does not overlap with the terminal parts of the second posts when viewed from a direction perpendicular to the mounting surface of the print wiring board. Accordingly, it is possible to simplify a process for mounting the receptacle on the printed wiring board.

BEST MODE FOR CARRYING OUT THE INVENTION

Hereinafter, exemplary embodiments of the present invention will be described with reference to the attached drawings.

FIRST EMBODIMENT

Figure 1:
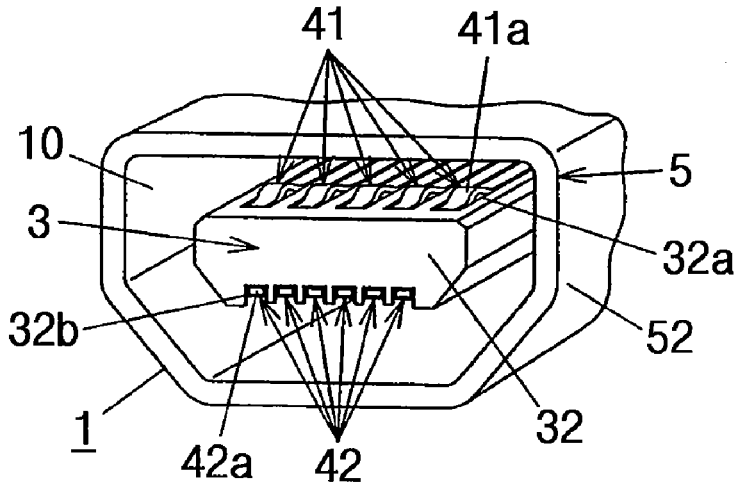
FIGS. 1(*a*) and 1(*b*) are perspective views showing a connector according to a first embodiment of the present invention, among which FIG. 1(*a*) shows a receptacle for the connector and FIG. 1(*b*) shows a plug for the connector.
Figure 1:
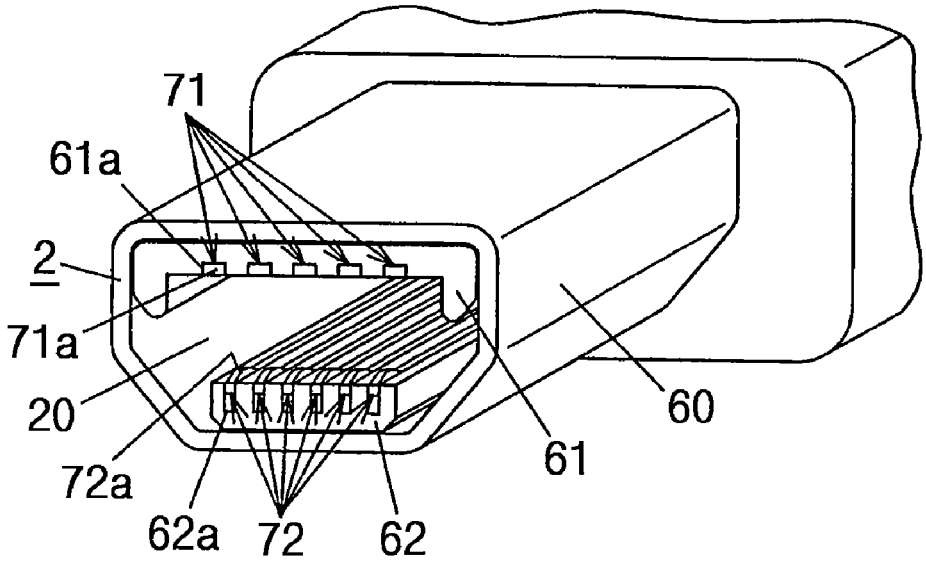

A connector according to a first embodiment of the present invention includes: a receptacle, as shown in FIG. 1(*a*), having second posts 42 in addition to first posts 41 similar to the mini-AB receptacle based on the existing USB On-The-Go (OTG) standard; and a plug 2, as shown in FIG. 1(*b*), having first contacts 71 corresponding to the first posts 41 and second contacts 72 corresponding to the second posts 42. The receptacle 1 is, for example, mounted on a printed wiring board (not shown) formed on a peripheral device, and the plug 2 is, for example, built on a front end of a cable (not shown). In the following description, the left, right, top, and bottom directions are defined by the direction in FIG. 1(*a*), that is, a direction extending from bottom-left to top-right in FIG. 1(*a*) is referred to a forward direction, and a direction extending from top-right to bottom-left in FIG. 1(*b*) is referred to as a backward direction. In addition, a mini-A (or mini-B or mini-AB) plug (or receptacle) based on the USB OTG standard (or USB 2.0 standard) will be simply referred to as a mini-A (or mini-B or mini-AB) plug (or receptacle).

Figure 2:
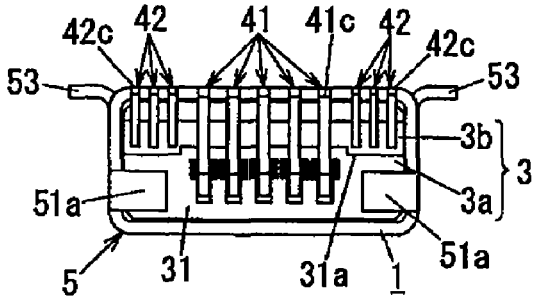
FIGS. 2(*a*) to 2(*e*) are views showing the receptacle according to the first embodiment, among which FIG. 2(*a*) is a front view, FIG. 2(*b*) is a top view, FIG. 2(*c*) is a rear elevation view, FIG. 2(*d*) is a right side view, and FIG. 2(*e*) is a sectional view taken along the A-A line shown in FIG. 2(*a*).
Figure 2:
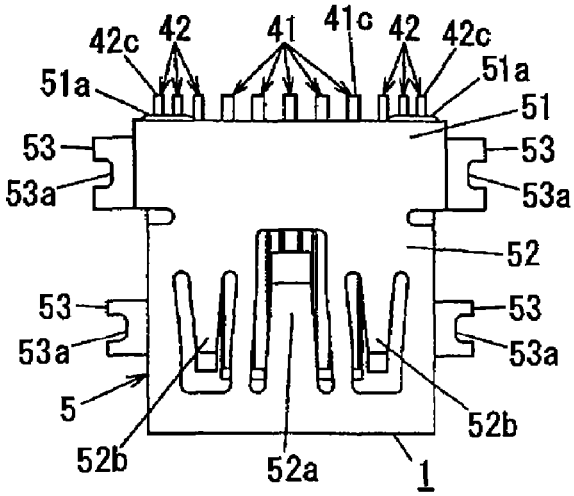
Figure 2:
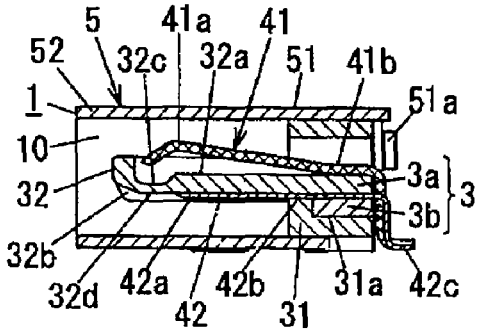
Figure 2:
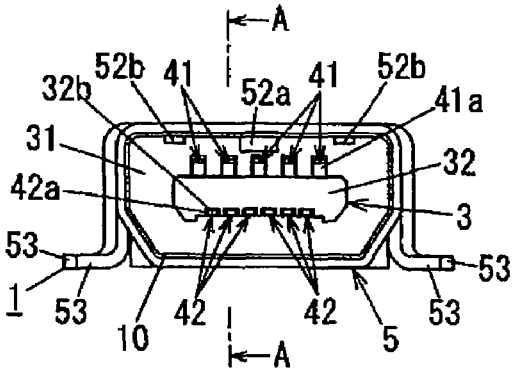
Figure 2:
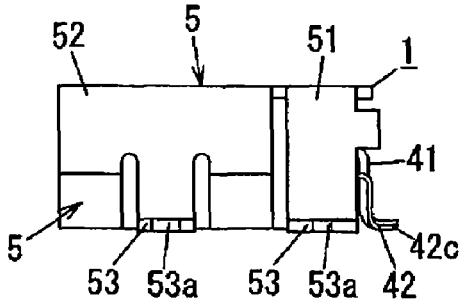

First, the receptacle 1 will be described with reference to FIGS. 2(*a*) to 2E. The receptacle 1 includes a base 3 having a rectangular parallelepiped main body 31 made of an insulating material such as a synthetic resin, and a flattened connecting part 32 protruding forward from the main body 31. The receptacle 1 further includes five first posts 41 having contact parts 41*a* made of a band-shaped metal plate and arranged on the connecting part 32 in a horizontal direction, and six second posts 42 having contact parts 42*a* made of a band-shaped metal plate and arranged under the connecting part 32 in a horizontal direction. In addition to the contact parts 41*a* and 42*a*, the first and second posts 41 and 42 have retaining parts 41*b* and 42*b* which penetrate the main body 31 of the base 3 from the front end to the rear end of the main body 31 and are retained in the base 3, and terminal parts 41*c* and 42*c*, which are used for mounting on a printed wiring board, protrude downward from a rear end of the retaining part 41*b* and 42*b*, and bent backward, thereby forming an L-shape. The contact parts 41*a* of the first posts 41 are inclined upward in a forward direction so as to elastically protrude above the connecting part 32. In addition, the front end portions of the contact parts 41*a* are bent downward in the vicinity of the front end portions of the first posts 41 so as to cause top surfaces of the front end portions to incline downward in a forward direction.

Figure 3:
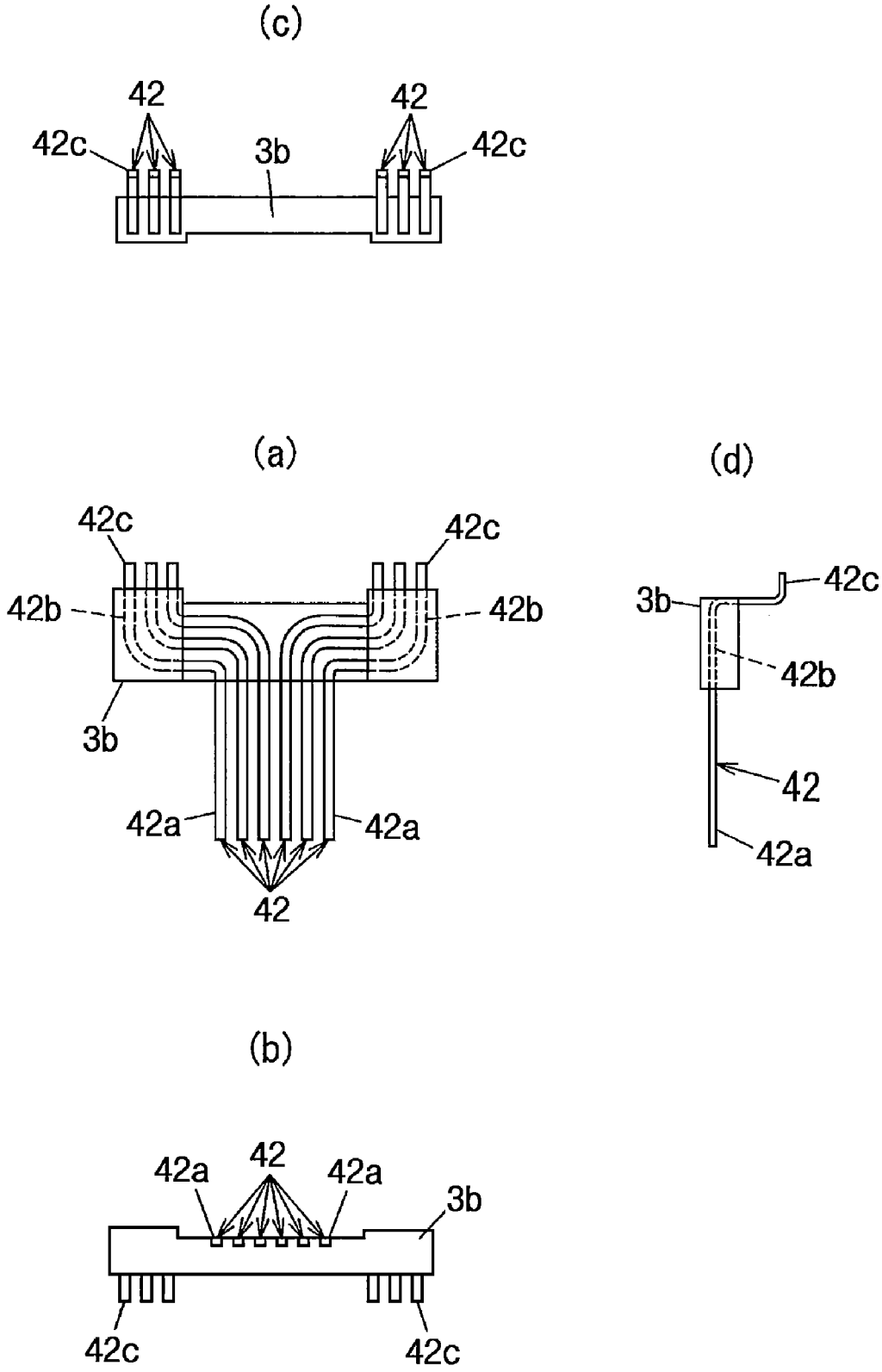
FIGS. 3(*a*) to 3(*d*) are views showing a portion of the receptacle according to the first embodiment, among which FIG. 3(*a*) is a top view, FIG. 3(*b*) is a front view, FIG. 3(*c*) is a rear elevation view, and FIG. 3(*d*) is a right side view.

The base 3 includes a first block 3*a* which mainly constitutes the base 3, has a concave portion 31*a* on the rear surface thereof, and retains the first posts 41, for example, by an insert molding method and a second block 3*b* which retains the second posts 42, for example, by an insert molding method and is inserted into the concave portion 41*a* of the first block 3*a*. As shown in FIG. 3(*a*), the retaining parts 42*b* of the second posts 42 are bent in an S-shape so as to divide the terminal parts 42*c* of the second posts 42 into three terminal parts 42*c* on both the left and right sides. The terminal part 41*c* of the first posts 41 is disposed between the terminal part 42*c* of the second posts 42 formed at a third position from the left and the terminal part 42*c* of the second posts 42 formed at a third position from the right. That is, when the first block 3*a* and the second block 3*b* are combined together, three terminal parts 42*c* of the second posts 42 are placed on both the left and right sides of the terminal part 41*c* of the first posts 41. In the first embodiment, since the terminal parts 41*c* and 42*c* of the first and second posts 41 and 42 are arranged in such a manner that the terminal part 41*c* of the first posts 41 does not overlap with the terminal parts 42*c* of the second posts 42 when viewed from the top portion of the print wiring board, it is possible to simplify a process for mounting the receptacle 1 on the printed wiring board.

In addition, elongated post receiving grooves 32*a* and 32*b* are formed on both the upper and lower surfaces of the connecting part 32 so as to dispose each of the first and second posts 41 and 42 in each of the post receiving grooves 32*a* and 32*b*. In this case, adjacent posts 41 and 42 are electrically isolated from each other by the base 3 made of an insulating material.

The receptacle 1 includes a shell 5 defining a fitting recess 10 between the main body 31 of the base 3 and the shell 5. The shell 5 is formed by stamping and bending a metal plate and coupled to the main body 31 of the base 3 so as to accommodate the connecting part 32 therein. The shell 5 includes a squared cylindrical coupling part 51 fitted to the main body 31 of the base 3, a squared cylindrical enclosing part 52 protruding forward from the coupling part 51 so as to surround the connecting part 32 of the base 3, and leg parts 53 protruding from the left and right sides of the shell 5 so as to form two leg parts 53 on each of the left and right sides. Slip-off preventive parts 51*a* formed on the rear side of the base 3 to prevent backward slipping of the base 3 protrude inward from the left and right sides of the rear end of the coupling part 51. In addition, the bottom surfaces of the terminal parts 41*c* and 42*c* of the first and second posts 41 and 42, the bottom surface of the coupling part 51 of the shell 5, the bottom surface of the enclosing part 51, and the bottom surfaces of the leg parts 53 are disposed approximately at the same height positions. Since the leg parts 53 have cutout portions 53*a*, it is possible to screw the receptacle 1 on the printed wiring board by using a screw (not shown) vertically inserted through the cutout portions 53*a* to be engaged with the printed wiring board.

Hereinafter, the plug 2 will be described. The plug 2 includes a cylindrical plug shell 60 made of a metal as shown in FIG. 1(*b*). The plug shell 60 has a dimension smaller than the fitting recess 10 so as to be fitted in the fitting recess 10. In addition, first and second contact retainers 61 and 62 made of an insulating material such as a synthetic resin and formed respectively on upper and lower inner surfaces of the plug shell 60, five first contacts 71 made of a band-shaped metal plate and having contact parts 71*a* retained parallel to each other in a horizontal direction by the first contact retainer 61 placed at an upper side of the retainers 61 and 62, and six second contacts 72 made of a conductive material and having contact parts 72*a* retained parallel to each other in a horizontal direction by the second contact retainer 62 palced at a lower side of the retainers 61 and 62 are provided on the inner surface of the plug shell 60. In the first embodiment, the plug shell 60 and the first and second contact retainers 61 and 62 constitute a fitting part of a body according to claims of the present invention. In addition, a connecting recess 20 capable of inserting the connecting part 32 of the receptacle 1 therein is disposed between the first and second contact retainers 61 and 62.

In addition, contact retaining grooves 61*a* and 62*a* corresponding to the number of the contacts 71 and 72 are formed in a horizontal direction on the contact retainers 61 and 62, respectively, so that each of the contacts 71 and 72 is arranged in a corresponding one of the contact retaining grooves 61*a* and 62*a*. In this case, adjacent contacts 71 and 72 are electrically isolated from each other by the contact retainers 61 and 62.

In addition, the rear end portion of the contact parts of the second contacts 72 are bent upward so as to elastically protrude upward from the second contact holder 62, i.e., toward the inner side of the connecting recess 20.

Figure 4:
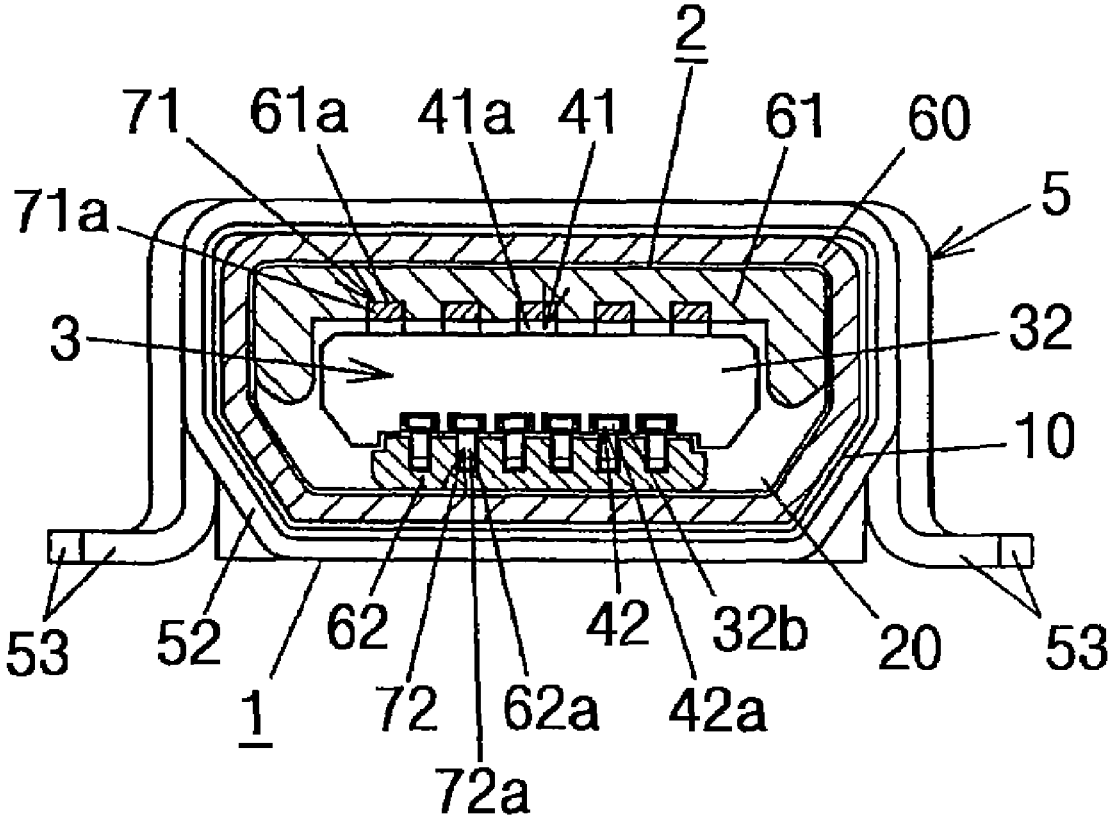
FIG. 4 is a sectional view showing a connection status between the plug and the receptacle according to the first embodiment.

When the plug 2 is connected to the receptacle 1, i.e., when the connecting part 32 is inserted into the connecting recess 20 by fitting the plug shell 60 to the fitting recess 10, as shown in FIG. 4, the contact parts 41*a* of the first posts 41 make an elastic contact with corresponding contact parts 71*a* of the first contacts 71, thereby forming an electrical connection, and the contact parts 42*a* of the first posts 42 make an elastic contact with corresponding contact parts 72*a* of the first contacts 72, thereby forming an electrical connection. In this case, contact pressure between the first posts 41 and the first contacts 71 is obtained by an elastic force of the first posts 41, and contact pressure between the second posts 42 and the second contacts 72 is obtained by an elastic force of the second contacts 72. Therefore, since it is unnecessary to prepare a space for elastic deformation around the second posts 42, it is possible to down size the receptacle 1 compared to the case where the second posts 42 are elastically deformed.

Figure 5:
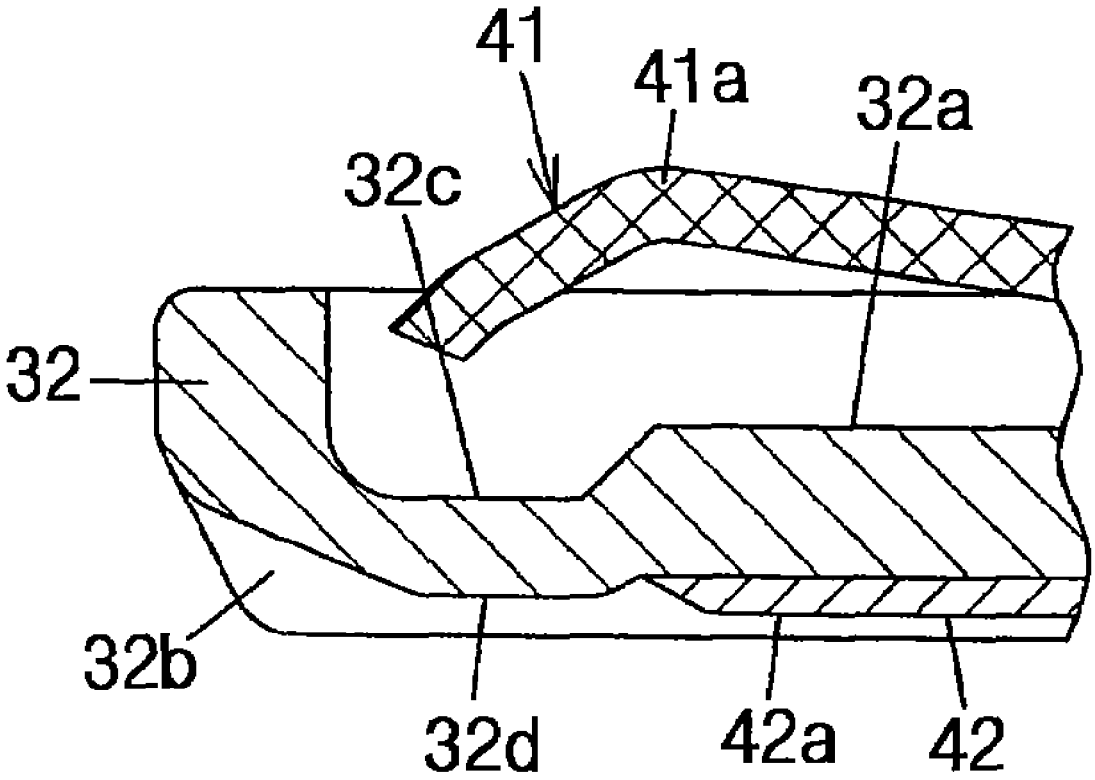
FIG. 5 is a sectional view showing a main part of the receptacle according to the first embodiment.

In addition, as shown in FIG. 5, evacuated recesses 32*c* for receiving the front end portions of the contact parts 41*a* of the first posts 41 when the plug 2 is connected to the receptacle 1 so as to elastically deform the first posts 41 are formed on the bottom surface of the post receiving grooves 32*a* where the first posts 41 are disposed. Front end portions of the second posts 42 are positioned in the rear side of the evacuated recesses 32*c*, and a reinforcing convex part 32*d* is formed on the lower side of the evacuated recess 32*c* so as to protrude downward from the connecting part 32. In this case, decrease in mechanical strength due to the thinning of the connecting part 32 by the evacuated recess 32*c* is reinforced by forming the reinforcing convex part 32*d*. In addition, the size of protrusion of the reinforcing convex part 32*d* is smaller than the thickness of the contact parts 42*a* of the second posts 42. Accordingly, the reinforcing convex part 32*d* does not increase the size of the receptacle 1.

Figure 6:
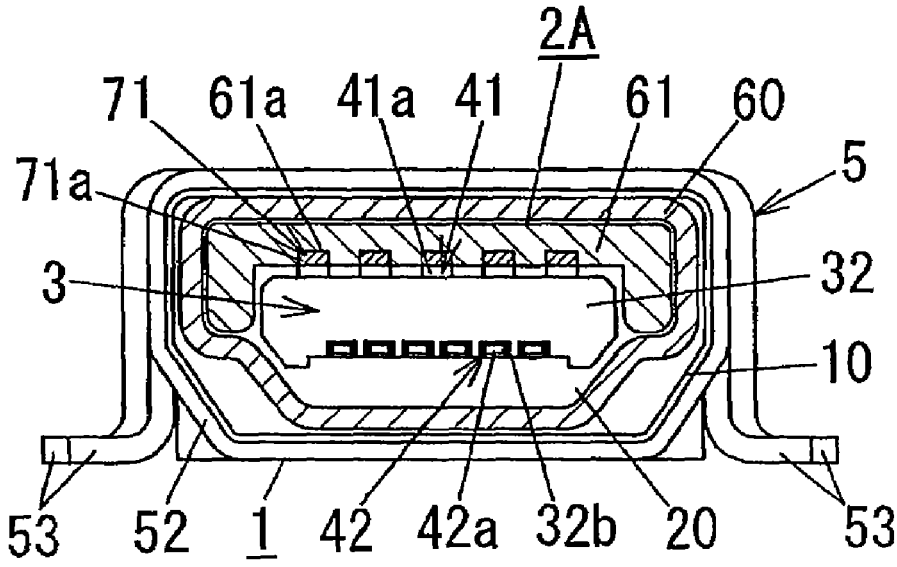
FIGS. 6(*a*) and 6(*b*) are sectional views showing a connection status between a mini-A plug and the receptacle and a connection status between a mini-B plug and the receptacle according to the first embodiment, respectively.
Figure 6:
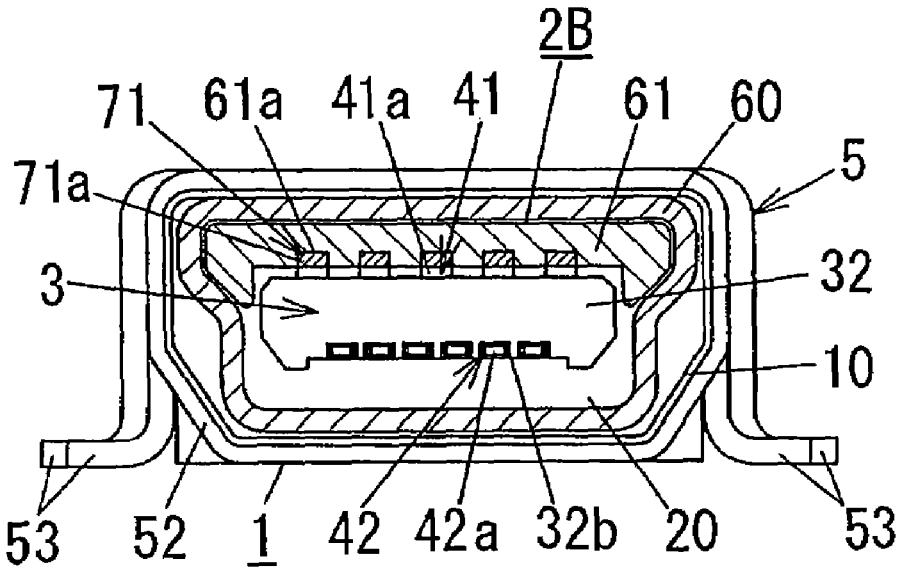

In the first embodiment, the receptacle 1 has a dimension compliant with the above-mentioned mini-AB receptacle, excepting that the distance between the bottom surface of the connecting part 32 and the inner surface of the shell 5 increases to secure a space for receiving the second contact retainer 62. Accordingly, either the mini-A plug 2A (see, FIG. 6(*a*)) or the mini-B plug 2B (see, FIG. 6(*b*)) can be connected to the receptacle 1 according to the first embodiment. In addition, the receptacle 1 includes a pair of engaging pieces 52*a* and 52*b* elastically protruding toward the inner side of the fitting recess 10 so as to engage with an engaging recess (not shown) formed on the upper surface of the fitting part of the nini-A plug 2A or the mini-B plug 2B, thereby preventing slipping of the engaging pieces 52*a* and 52*b*. The engaging pieces 52*a* and 52*b* are formed on the enclosing part 52 of the shell 5 by cutting and raising three portions of the enclosing part 52 in a horizontal direction.

In the present invention, the size of protrusion of the contact parts 42*a* of the second posts 42 from the bottom surface of the contact receiving groove 32*b* at the lower side of the connecting part 32 is smaller than the depth of the contact receiving groove 32*b* at the lower side of the connecting part 32, and the contact parts 42*a* of the second posts 42 do not protrude downward from the connecting part 32. Accordingly, even when the mini-A plug 2A or the mini-B plug 2B which does not have the second contacts 72 is connected to the receptacle 1, since the contact parts 42*a* of the second posts 42 do not make contact with the plug 2A or 2B, it is possible to suppress adhering of exogenous materials attached to the plug 2A or 2B to the contact parts 42*a* of the second posts 42 or breakage of the second posts 42.

On the other hand, since the distance between the first contact retainer 61 and the second contact retainer 62 is smaller than the thickness of connecting parts (not shown) of the mini-AB receptacle, when the plug 2 of the first embodiment is to be inserted into fitting recess (not shown) of the mini-AB receptacle, the second contact retainer 62 of the plug 2 interferes with the connecting part of the mini-AB receptacle. Accordingly, it is impossible to insert the plug 2 of the first embodiment into the fitting recess of the mini-AB receptacle. Similarly, it is impossible to insert the plug 2 of the first embodiment into the fitting recess of the mini-A receptacle (not shown) or the mini-B receptacle (not shown). In the first embodiment, the second contact retainer 62 corresponds to a blocking part according to claims of the present invention, and a gap formed on the lower side of the connecting part 32 corresponds to a receiving part according to claims of the present invention. In this case, if the plug 2 having the second contacts 72 is to be inserted into the known receptacle such as the mini-AB receptacle which does not have the second posts 42, since the contact parts 72*a* of the second contact 72 make elastic contact with the lower surface of the connecting part 32 which does not have the second posts 42 when the plug 2 is erroneously inserted into the known receptacle, there is a chance of adhering of exogenous materials attached to the lower surface of the connecting part 32 to the contact parts 72*a* of the second contacts 72 or breakage of the second contacts 72. However, since it is impossible to insert the plug 2 of the first embodiment into the known receptacle, the adhering of exogenous materials or the breakage of the second contacts is prevented.

According to the above-mentioned arrangement, since the receptacle 1 can be used as a receptacle for the USB connector, data which are transmitted through the known USB connector can be transmitted by using the first posts 41 and the first contacts 71, and other data can be transmitted by using the second posts 42 and the second contacts 72, it is possible to down size the peripheral device compared to the case where the size is increased when a connector for transmitting the other data is installed in addition to the USB connector.

In addition, while the number of the second posts 42 and the second contacts 72 was six in the first embodiment, however, it is not limited to this number.

SECOND EMBODIMENT

A basic structure of the second embodiment is similar to that of the first embodiment and like reference numerals in the drawings denote like elements.

Figure 7:
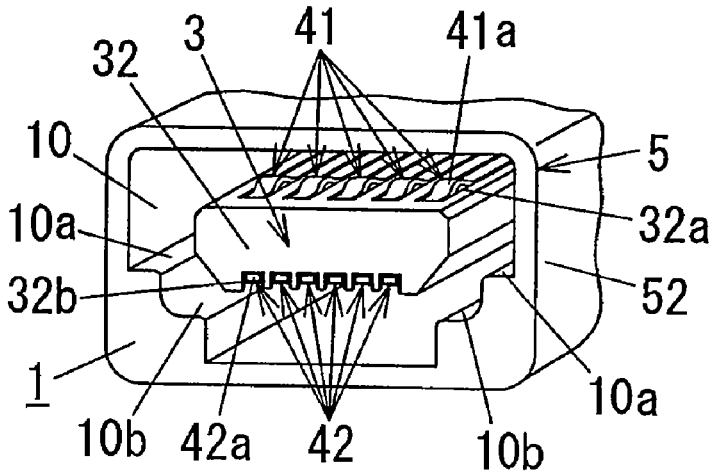
FIGS. 7(*a*) and 7(*b*) are perspective views showing a connector according to a second embodiment of present invention, among which FIG. 7(*a*) shows a receptacle for the connector and FIG. 7(*b*) shows a plug for the connector.
Figure 7:
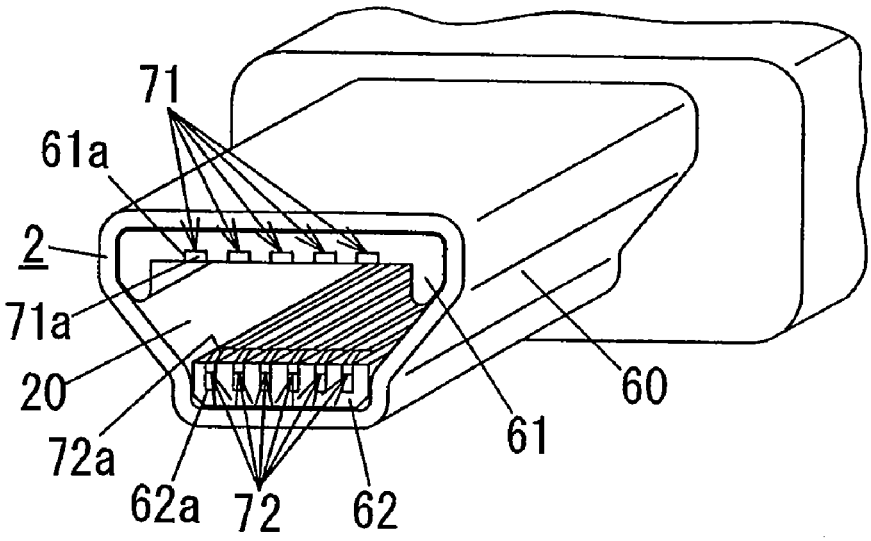

As shown in FIGS. 7(*s*) and 7(*b*), the dimensions of the receptacle 1 and the plug 2 according to the second embodiment are different from those of the first embodiment.

In the first embodiment, it is made impossible to insert the plug 2 into the mini-AB receptacle by making the distance between the first contact retainer 61 and the second contact retainer 62 smaller than the depth of the connecting part (not shown) of the mini-AB receptacle. To the contrary, in the second embodiment, it is made impossible to insert the plug 2 into the mini-AB receptacle by making the height of the plug shell 60 greater than the height of the fitting recess (not shown) of the mini-AB receptacle. In the second embodiment, the plug shell 60 corresponds to a blocking part according to claims of the present invention. In addition, in order to make it possible to insert the plug shell 60 into the receptacle 1, the height of the fitting recess 10 of the receptacle 1 should be large.

Figure 8:
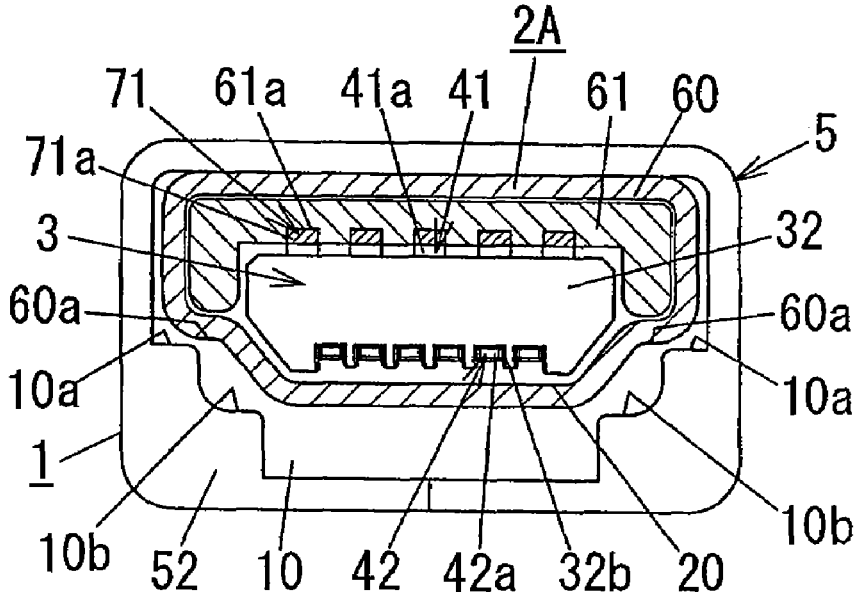
FIGS. 8(*a*) and 8(*b*) are sectional views showing a connection status between a mini-A plug and the receptacle and a connection status between a mini-B plug and the receptacle according to the second embodiment, respectively.
Figure 8:
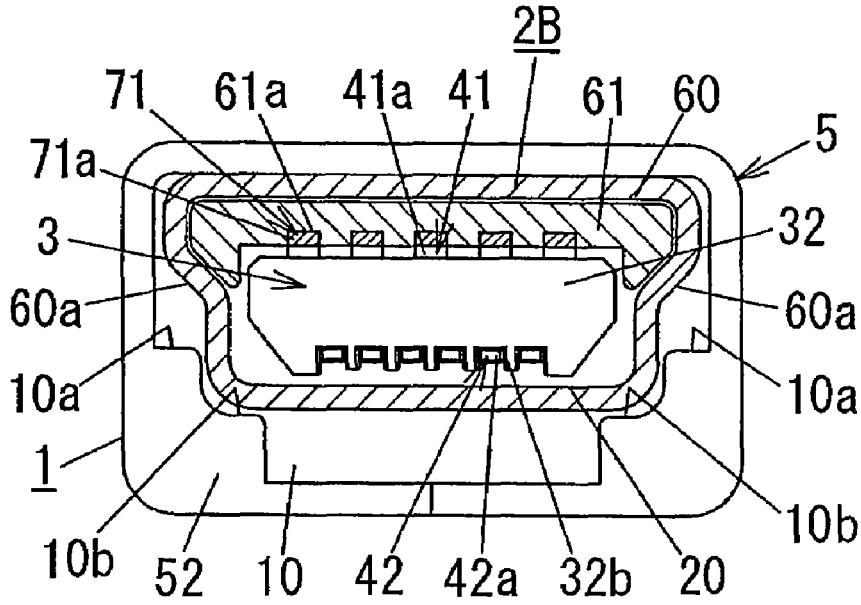
Figure 9:
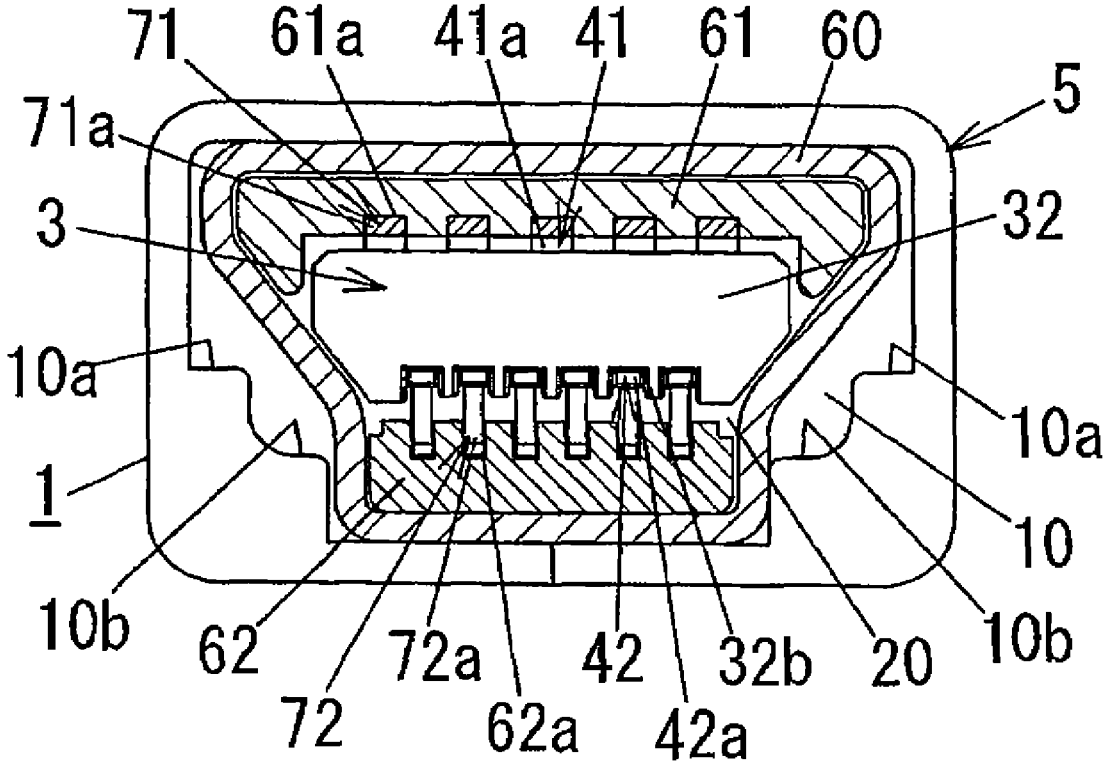
FIG. 9 is a sectional view showing a connection status between the plug and the receptacle according to the second embodiment.

As shown in FIGS. 8(*a*) and 8(*b*), a step 60*a* having a lower width and an upper width wider than the lower width is formed on each of the left and right side surfaces of the plug shell 60 of the mini-A plug 2A and the mini-B plug 2B. The distance between the upper surface of the plug shell 60 and the step 60*a* in the mini-A plug 2A is greater than that of the mini-B plug 2B, and the width of the lower surface of the plug shell 60 in the mini-B plug 2B is greater than that of the mini-A plug 2A.

In the receptacle 1 of the second embodiment, upper and lower steps 10*a* and 10*b* are formed on the inner surface of the enclosing part 52 of the shell 5, i.e., the inner surface of the fitting recess 10, so that the width of the fitting recess 10 in a horizontal direction gradually decreases in a stepwise manner in a downward direction. At above the upper step 10*a*, the width of the fitting recess 10 in a horizontal direction is slightly greater than that of the plug shell 60 of the mini-A plug 2A or the mini-B plug 2B. In addition, the distance between the upper surface of the fitting recess 10 and the upper step 10*a* is slightly greater than the distance between the upper surface of the plug shell 60 of the mini-A plug 2*a* and the step 60*a*.

Accordingly, as shown in FIG. 8(*a*), when the mini-A plug 2A is inserted into the receptacle 1 of the second embodiment, left and right end portions of the plug shell 60 of the mini-A plug 2A, i.e., portions having a small width in the depth direction of the fitting part are inserted between the upper surface of the fitting recess 10 and the upper step 10*a* with a small gap therebetween. In the second embodiment, the upper surface of the fitting recess 10 and the upper step 10*a* constitute a first clamping part according to claims of the present invention.

In addition, the distance between the upper surface of the fitting recess 10 and the lower step 10*b* is slightly greater than the height of the portion inserted into the step 60*a* of the mini-B plug 2B, and the distance of the lower step 10*b* of the fitting recess 10 is smaller than the width of the plug shell 60 of the mini-B plug 2B which is inserted into the step 60*a*.

Accordingly, as shown in FIG. 8(*b*), when the mini-B plug 2B is connected to the receptacle 1 of the second embodiment, a portion of the plug shell 60 of the mini-B plug 2B which is inserted into the step 60*a*, i.e., a portion having a large width in the depth direction of the fitting part is inserted between the upper surface of the fitting recess 10 and the lower step 10*b* with a small gap therebetween. In the second embodiment, the upper surface of the fitting recess 10 and the lower step 10*b* constitute a second clamping part according to claims of the present invention.

When the mini-A plug 2A or the mini-B plug 2B is connected to the receptacle 1, the plug 2A or 2B is supported only by the connecting part 32, and the plug 2A or 2B is twisted, excessive force is applied to the connecting part 32 of the receptacle 1, thereby causing a chance of breakage of the connecting part 32. In the second embodiment, however, since the plug 2A or 2B is supported by the first and second clamping parts, excessive force is not likely to be applied to the connecting part 32 of the receptacle 1, thereby eliminating the possibility of breakage of the connecting part 32.

In addition, the mini-A plug 2A or the mini-B plug 2B is not likely to enter into a space below the lower step 10*b* in the fitting recess 10*b*, and a lower end portion of the plug 2 of the second embodiment is received into the space. In the second embodiment, the space corresponds to a receiving part according to claims of the present invention, and the lower end portion of the plug 2 corresponds to a blocking part according to claims of the present invention.

According to the above-mentioned arrangement, it is possible to obtain advantages approximately similar to those of the first embodiment.

According to the present invention, since the mini-A plug or the mini-B plug based on the USB standard can be connected to the receptacle, and data other than the data which are transmitted through the known USB connector can be transmitted by using the second posts and the second contacts, it is possible to down size the peripheral device compared to the case where the size is increased when a connector for transmitting the other data is installed in addition to the USB connector.

What is claimed is:

1. A connector comprising:

a receptacle capable of receiving both a mini-A plug and a mini-B plug based on a USB standard, the receptacle including:

a base made of an insulating material, having a main body and a flattened connecting part protruding from the main body;

a plurality of first posts made of a conductive material, having contact parts retained on one surface of the connecting part in the width direction of the connecting part; and a shell coupled to the main body of the base so as to form a fitting recess for accommodating the connecting part therewith, and a plug including:

a body having a fitting part with a connecting recess which receives the connecting part of the receptacle therein and is fitted to a fitting recess; and a plurality of first contacts made of a conductive material and retained in the connecting recess so as to make an electrical contact with a corresponding one of the contact parts of the first posts when the connecting part of the base is inserted into the connecting recess of the body, wherein the receptacle has a plurality of second posts made of a conductive material, having contact parts retained on an opposite surface of the first posts of the connecting part in a direction intersecting the protruding direction of the connecting part, and wherein the plug has a plurality of second contacts made of a conductive material, having contact parts retained in the connecting recess of the body so as to make an electrical contact with the contact parts of the second posts when the connecting part is inserted into the connecting recess of the body.

2. The connector according to claim 1, wherein the contact parts of the second contacts elastically protrude toward the inner side of the connecting recess, and contact pressure between the contact parts of the second contacts and the contact parts of the second posts is obtained by an elastic force of the contact parts of the second contacts.

3. The contact according to claim 1, wherein the contact parts of the first posts elastically protrude in the width direction of the connecting part, the front end portions of the contact parts of the first posts are bent toward the connecting part, and evacuated recesses for receiving the front end portions of the contact parts of the first posts when the contact parts of the first posts are elastically deformed are formed on the connecting part, and wherein the front end portions of the second posts are disposed in the fitting recess at a position deeper than the evacuated recesses, a reinforcing convex part protruding in the depth direction of the connecting part from a portion opposing to the contact parts of the second posts of the connecting part is formed on a surface opposite to the surface where the evacuated recesses of the connecting part are formed, and the size of protrusion of the reinforcing convex part is smaller than the depth of the contact parts of the second posts.

4. The connector according to claim 1, wherein a blocking part for preventing the insertion of the plug into the fitting recess of the mini-AB receptacle based on the USB standard is formed on the plug, and a receiving part for receiving the blocking part is formed on the fitting recess of the receptacle.

5. The connector according to claim 1, wherein receiving grooves for receiving the contact parts of the second posts are formed on the connecting part of the receptacle, and the height of protrusion of the contact parts of the second posts from the bottom surface of the receiving grooves is lower than the depth of the receiving grooves.

6. The connector according to claim 1, wherein the size of the fitting part of the plug is smaller than the thickness of the fitting part of the mini-A plug or the fitting part of the mini-B plug based on the USB standard, and the size of the fitting recess of the receptacle is larger than the thickness of the fitting recess of the mini-AB receptacle based on the USB standard, whereby the fitting part of the plug is fitted to the fitting recess of the receptacle, and wherein a first clamping part for inserting portions having a small width in the depth direction of the fitting part of the mini-A plug based on the USB standard between both sides of the thickness direction with a small gap therebetween, and a second clamping part for inserting portions having a large width in the thickness direction of the fitting part of the mini-B plug based on the USB standard between both sides of the depth direction with a small gap therebetween are formed on the inner surface of the fitting recess of the receptacle.

7. The connector according to claim 1, wherein the first and second posts have terminal parts disposed at an opposite side to the connecting part with the main body of the base therebetween and used for mounting on a printed wiring board, and the terminal parts of the second posts are disposed at both sides of the width direction of the connecting part with the terminal parts of the first posts therebetween.

* * * * *